US010246919B2

(12) United States Patent
Mair et al.

(10) Patent No.: US 10,246,919 B2
(45) Date of Patent: Apr. 2, 2019

(54) SWINGING-SLIDING DOOR MODULE FOR A RAIL VEHICLE WITH IMPROVED OVER-CENTRE LOCKING

(71) Applicant: KNORR-BREMSE GESELLSCHAFT MIT BESCHRÄNKTER HAFTUNG, Mödling (AT)

(72) Inventors: Andreas Mair, Oberschlierbach (AT); Heinz Zarl, Zeilem (AT)

(73) Assignee: KNORR-BREMSE GESELLSCHAFT MIT BESCHRANKTER HAFTUNG (AT)

( * ) Notice: Subject to any disclaimer, the term of this patent is extended or adjusted under 35 U.S.C. 154(b) by 0 days.

(21) Appl. No.: 15/024,328

(22) PCT Filed: Sep. 19, 2014

(86) PCT No.: PCT/AT2014/050213
§ 371 (c)(1),
(2) Date: Mar. 23, 2016

(87) PCT Pub. No.: WO2015/039160
PCT Pub. Date: Mar. 26, 2015

(65) Prior Publication Data

US 2016/0215543 A1 Jul. 28, 2016

(30) Foreign Application Priority Data

Sep. 23, 2013 (AT) ..... A 50610/2013

(51) Int. Cl.
*E05D 15/10* (2006.01)
*B61D 19/00* (2006.01)
*E06B 3/50* (2006.01)

(52) U.S. Cl.
CPC ..... *E05D 15/1068* (2013.01); *B61D 19/008* (2013.01); *E06B 3/5009* (2013.01);
(Continued)

(58) Field of Classification Search
CPC ..... E05D 15/1007; E05D 15/1068; B61D 19/008; B61D 19/009
See application file for complete search history.

(56) References Cited

U.S. PATENT DOCUMENTS 1,300,475 A * 4/1919 O'Connor ..... E05D 15/1007 49/220
3,383,798 A * 5/1968 Day ..... B61D 19/009 49/219
(Continued)

FOREIGN PATENT DOCUMENTS

AT 512365 A1 * 7/2013 ..... E05D 15/1068
CH 402649 A * 11/1965 ..... B60J 5/062
(Continued)

OTHER PUBLICATIONS

Austrian examination report dated Jun. 24, 2015.
(Continued)

*Primary Examiner* — Catherine A Kelly
(74) *Attorney, Agent, or Firm* — Barnes & Thornburg LLP

(57) ABSTRACT

A swinging-sliding door module for a rail vehicle is provided, the swinging-sliding door module including a door leaf and a rotatably mounted rotary pillar coupled to the door leaf. Furthermore, the swinging-sliding door module includes a support which is oriented longitudinally in the sliding direction of the door leaf and is mounted so as to be displaceable transversely with respect to the longitudinal extent thereof in the horizontal direction in relation to the rotary pillar and in which the door leaf is mounted displaceably. A first over-center locking brings about the deployment movement of the support. Furthermore, the coupling between rotary pillar and door leaf includes a second over-center locking which acts in the deployment direction of the door leaf.

16 Claims, 6 Drawing Sheets

(52) U.S. Cl.
CPC ... *E05D 2015/1071* (2013.01); *E05Y 2201/22* (2013.01); *E05Y 2201/222* (2013.01); *E05Y 2201/608* (2013.01); *E05Y 2900/51* (2013.01)

(56) References Cited

U.S. PATENT DOCUMENTS

| | | | | | |
|---|---|---|---|---|---|
| 3,386,204 | A * | 6/1968 | Obata | B60J 5/06 | 49/212 |
| 4,114,318 | A * | 9/1978 | Brindle | E05D 15/1002 | 49/215 |
| 5,207,024 | A * | 5/1993 | Epema | B60J 5/062 | 49/130 |
| 5,483,769 | A * | 1/1996 | Zweili | B61D 19/008 | 49/118 |
| 5,893,236 | A * | 4/1999 | Krbec | B61D 19/008 | 49/118 |
| 6,385,910 | B1 * | 5/2002 | Smink | B60J 5/062 | 49/120 |
| 6,539,669 | B1 * | 4/2003 | Heidrich | B61D 19/008 | 16/87 R |
| 7,887,106 | B2 * | 2/2011 | Jarolim | E05D 15/1068 | 292/201 |
| 8,814,282 | B2 * | 8/2014 | Halfon | E05D 15/10 | 312/109 |
| 9,403,422 | B2 * | 8/2016 | Takahashi | B61D 19/02 | |

FOREIGN PATENT DOCUMENTS

| | | | | |
|---|---|---|---|---|
| DE | 662233 | C * | 7/1938 | B61D 19/008 |
| EP | 0744516 | A1 | 11/1996 | |
| EP | 1314626 | B1 | 5/2003 | |
| EP | 1568563 | A1 | 8/2005 | |
| EP | 1767388 | A2 | 3/2007 | |
| FR | 2589938 | A1 * | 5/1987 | B61D 19/009 |
| JP | H02-27509 | B2 | 6/1990 | |

OTHER PUBLICATIONS

Search report for International Patent Application No. PCT/AT2014/050213; dated Jan. 28, 2015.
Japanese Office Action for corresponding application JP 2016-516586 dated May 10, 2017.

* cited by examiner

SWINGING-SLIDING DOOR MODULE FOR A RAIL VEHICLE WITH IMPROVED OVER-CENTRE LOCKING

PRIORITY CLAIM

This patent application is a U.S. National Phase of International Patent Application No. PCT/AT2014/050213, filed 19 Sep. 2014, which claims priority to Austrian Patent Application No. A 50610/2013, filed 23 Sep. 2013 the disclosure of which are incorporated herein by reference in their entirety.

FIELD

Illustrative embodiments relate to a swinging-sliding door module for a rail vehicle, comprising a door leaf, a rotary pillar which is coupled to the door leaf and is mounted rotatably, and a support which is oriented longitudinally in the sliding direction of the door leaf. The support mentioned is mounted displaceably in the horizontal direction transversely with respect to the longitudinal extent thereof in relation to the rotary pillar. In addition, the door leaf is mounted displaceably in the support. Finally, the swinging-sliding door module also comprises a first over-center locking acting on the support in the deployment direction of the door leaf.

It is disadvantageous that the door leaf is only inadequately fixed in the lower region and therefore can be pushed outward there even in the closed position. Despite the over-center locking of the support, smaller objects could drop out of the vehicle. At least, pressure fluctuations upon tunnel entries and train passings may lead to tightness problems or to excessive generation of noise if the door leaf is raised from the seal and therefore—at least for a short time—a direct connection is provided between train interior and exterior. This at any rate impairs the subjective sensation of safety of the passengers and also causes a detraction in traveling comfort.

SUMMARY

Disclosed embodiments provide an improved swinging-sliding door module. In particular, the door leaf, in the closed position thereof, is intended to remain in contact with the seal even in the event of very different actions on the door leaf.

BRIEF DESCRIPTION OF FIGURES

Exemplary embodiments will be discussed in greater detail in the following text together with the figures, in which.

DETAILED DESCRIPTION

Figure 1:
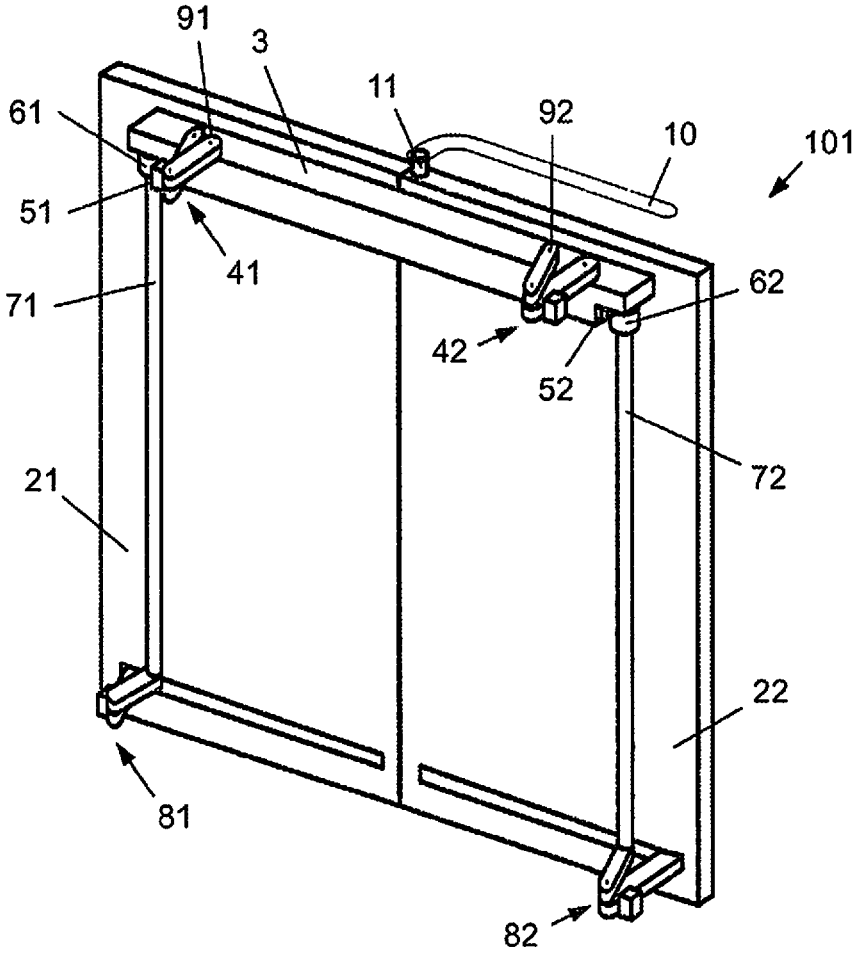
FIG. 1 shows a first schematically illustrated example of a swinging-sliding door module, in which a laterally deployable support is coupled to the rotary pillar via a rack drive.

Disclosed embodiments use a swinging-sliding door module of the type basically known, for example, EP 1 314 626 B1, which discloses a swinging-sliding door for vehicles with at least one door leaf which is displaceable in the longitudinal direction thereof, is suspended in a supporting guide and is guided displaceably. The coupling between the rotary pillar and door leaf comprises a second over-center locking which acts in the deployment direction of the door leaf.

In this manner, the door leaf is not only kept in position with the aid of an over-center locking in the region of the support but also in the region of the coupling between rotary pillar and door leaf. As a result, the door leaf remains in the closed position thereof in contact with the seal even in the event of very different actions on the door leaf. The subjective sensation of safety of the passengers and the traveling comfort thereof are thus improved. It is also no longer possible for small objects to drop out of the train. Alternatively or additionally to the locking in the closed position, the first and second over-center lockings can also be effective in the open position.

Further possible refinements and developments of the disclosed embodiments emerge from the dependent claims and from the description in conjunction with the figures.

It is possible if the swinging-sliding door module comprises a door drive system acting on the first over-center locking and, via the rotary pillar, on the second over-center locking. As the result, the door leaf can be moved in the deployment direction. In addition, it is advantageous if the door drive system comprises a linear drive which is coupled to the door leaf and acts in the sliding direction thereof. As the result, the door leaf can also be moved in the sliding direction thereof. The swinging-sliding door module therefore comprises a door drive system which brings about a deployment movement and a displacement movement of the door leaf, wherein the door drive system comprises a first over-center locking acting on the support in the deployment direction of the door leaf, and a rotary drive for the rotary pillar.

It is particularly possible if the door drive system has only a single motor. The swinging-sliding door module can thereby be constructed very compactly and also simply in terms of control technology.

It is possible if the support is arranged in the upper region of the door leaf and the second over-center locking is arranged in the lower region of the door leaf. The door leaf can thereby be fixed particularly readily.

It is furthermore possible if a further second over-center locking is arranged between the coupling of the rotary pillar to the support and the second over-center locking in the lower region of the door leaf, in particular in the central region of the door leaf. The door leaf can thereby be fixed even more readily since the door leaf is kept in the position thereof at yet further points with the aid of an over-center locking.

In addition, it is possible if the rotary pillar is mechanically coupled to the support. In this manner, a driving force can be transmitted from the support to the rotary pillar or vice versa. It therefore suffices if the support or the rotary pillar is driven by motor. By the coupling, the movement is transmitted from the part driven by motor to the part not driven by motor.

It is particularly possible if the coupling between rotary pillar and support is formed by a gearwheel which is arranged on the rotary pillar and is in engagement with a linear toothing arranged on the support. In this variant, the translatory movement of the support is converted into a rotatory movement of the rotary pillar or vice versa. In accordance with at least one embodiment, a cylindrical gear which is in engagement with a rack arranged on the support or included by the latter is arranged on the rotary pillar. However, it would also be conceivable for a crown gear which is in engagement with a rack arranged on the support or included by the latter to be arranged on the rotary pillar. In this arrangement, the rack is rotated by 90° in relation to the cylindrical gear arrangement. Finally, it would also be conceivable for a bevel gear which is in engagement with a rack arranged on the support or included by the latter to be arranged on the rotary pillar.

It is also possible if the coupling between rotary pillar and support comprises a rotary lever which is arranged on the rotary pillar and is guided in a slotted guide arranged on the support, or is connected via at least one further lever to the support, or is connected via at least one further lever to the first over-center locking. In this manner, it is possible, for example, even for nonuniform movements to be realized between support and rotary pillar, or the force transmission between the support and rotary pillar can also be nonuniform.

It is furthermore possible if the rotary pillar has a torsion damper between the coupling of the rotary pillar to the support and the second over-center locking. The support and the second over-center locking can thereby be decoupled in respect of the dynamic behavior or vibration behavior thereof. Dynamic influences occurring on a rail vehicle, in particular vibrations, may lead to an over-center locking overcoming the dead center and a door suddenly springing open. In particular at high speeds, this may lead to hazardous situations, in the worst case to injury or even to death of passengers. However, the effect which can be achieved by the torsion damper mentioned is that one of the two over-center lockings remains closed even if the other jumps open—triggered by dynamic phenomena. The door therefore then still remains closed even if one of the over-center lockings overcomes the dead center. The safety of the passengers is therefore significantly increased. Although an possible, that is to say different, vibration behavior of the first and second over-center lockings is in any case already produced by the asymmetric distribution of mass between support and rotary pillar, this can be improved even more and also influenced in a targeted manner by the use of a torsion damper.

It is also particularly advantageous if the rotary pillar has a torsion damper between two second over-center lockings. As the result, over-center lockings arranged on the rotary pillar can be decoupled in respect of the dynamic behavior or vibration behavior thereof. What has been stated previously applies here by analogy, wherein the safety is increased once again since the different over-center lockings jump open—if at all—in the event of different dynamic excitations and therefore the majority of the over-center lockings always remain closed.

It is also possible if a movement coupling between the first over-center lockings and the second over-center lockings is designed in such a manner that the deployment movement of the first over-center locking takes place at a different speed than the deployment movement of the second over-center locking and/or the deployment movements mentioned being or end in a staggered manner. The effect can thereby be achieved that the door leaf is rotated about a horizontal axis running in the plane of the door leaf during the deployment movement. As the result, a type of shearing movement takes place between door leaf and door seal, and therefore door leaf and seal are in contact only in a small region and only comparatively frictional forces occur. In particular in the event of icing in the sealing region, the driving forces for opening the door, upon which the ice is jettisoned, can thus be kept small.

The rotational movement mentioned can be realized by the fact that the door leaf is moved at a different speed at the top than at the bottom. If the door leaf is moved more rapidly at the top, the door leaf tips outward at the top during opening. If the door leaf is moved more slowly at the top, the door leaf tips inward at the top. A similar effect can be obtained if the movement is initiated in a staggered manner. If the door leaf is first of all deployed outward at the top and, in a staggered manner, at the bottom, the door leaf tilts outward at the top during opening. If the movement is first of all initiated at the bottom, the door leaf then tilts inward at the top. Of course, both operations can be combined, that is to say the movement can be initiated in a staggered manner at the top and bottom and can take place at a different speed. Alternatively or additionally to vertical tilting, horizontal tilting can also take place; that is, the door leaf can first of all be deployed on the left or right. If the horizontal tilting is combined with the vertical tilting, the advantages mentioned are particularly apparent since the frictional forces between seal and door are particularly small because of the tilting "across the corner".

It may be stated at the outset that identical parts are provided with the same reference numbers or same component designations in the variously described embodiments, wherein the disclosures contained throughout the description can be transferred analogously to identical parts with the same reference numbers or identical component designations. The position details selected in the description, such as, for example, at the top, at the bottom, laterally, etc. also relate to the immediately described and illustrated figure and, in the event of a change in position, can be transferred analogously to the new position. Furthermore, individual features or combinations of features from the various exemplary embodiments shown and described may constitute solutions which are independent, inventive or are according to the disclosed embodiments per se.

FIG. 1 shows an exemplary embodiment of a swinging-sliding door module 101. The swinging-sliding door module 101 comprises two door leaves 21, 22 and a support 3 which is oriented longitudinally in the sliding direction of the door leaves 21, 22 and is mounted displaceably in the horizontal direction transversely with respect to the longitudinal extent thereof. A linear guide with the aid of which the door leaves 21, 22 are mounted displaceably is arranged in or on the support 3. During the opening of the door, the support 3 is displaced in the deployment direction, which can take place, for example, with the aid of the two first over-center lockings 41 and 42.

The deployment movement of the support 3 is converted by racks 51, 52, which are arranged laterally on the support 3, into a rotational movement of gearwheels 61 and 62. The gearwheels 61 and 62 are mounted on rotary pillars 71 and 72, as the result of which the latter are also set into rotation and activate the second over-center lockings 81 and 82. The over-center lockings 41, 42, 81, 82 each comprise a rotatably mounted deployment lever, a connecting lever connected to the latter in an articulated manner, and a stop (also see FIG. 2).

To understand the function, it is also noted that the rotary pillars 71 and 72 are mounted in rotary bearings which are anchored fixedly in the rail vehicle. Furthermore, the bearing points 91 and 92 are also anchored fixedly in the rail vehicle and thus support the connecting levers. If the deployment levers of the first (upper) over-center lockings 41 and 42 are now set into rotation, the connecting levers are supported at the bearing points 91 and 92 and lock the support 3 in the deployment direction.

In principle, the deployment movement and sliding movement of the door leaves 21, 22 can take place with a plurality of separate motors. For example, a first motor sets the support 3 and therefore also the rotary pillars 71 and 72 into movement (or else vice versa), whereas a second motor is provided for the sliding movement of the door leaves 21, 22. The first motor, for example, can set the levers of the first over-center lockings 41 and 42 into rotation. The second motor is activated in a staggered manner and therefore brings about the sliding movement which can be realized, for example, in a manner known per se with a rack drive, a spindle drive or else via a cable pull.

However, it is possible if the door drive system has a single motor which brings about both the deployment movement and the sliding movement of the door leaves 21, 22. For example, the motor can be connected to a gearing which has two output shafts. One of the shafts can then be connected to the deployment levers (see FIG. 2) of the first over-center lockings 41 and 42, and the other shaft can be connected to the linear drive system. The use of a planetary gearing or else of a motor, in which both the rotor and the stator form a main drive pinion, would also be conceivable. The stator is then not fixedly connected to the swinging-sliding door module 101, as is generally customary, but rather is mounted rotatably like the rotor.

It is possible if a door leaf 21, 22 is guided in a slotted guide, which is arranged fixedly in relation to the rail vehicle, and therefore the deployment movement and the sliding movement are always carried out in a predetermined relation to each other, i.e. the two movements are mixed. For this purpose, this slotted guide can have a first rectilinear portion which is oriented in the sliding direction of the sliding door, a second portion which is oriented normally to the first portion, and a curved section which connects the two rectilinear portions. Accordingly, in the first portion, only the sliding movement is permitted and, in the second portion, only the deployment movement is permitted, whereas the sliding movement and the deployment movement are carried out simultaneously in the curved portion.

FIG. 1 shows an example of a slotted guide 10 (illustrated by thin lines) in which a pin 11 is guided. In FIG. 1, only one of the door leaves 22 is guided in a slotted guide 10 since it is assumed that the door leaf 21 is kinematically coupled to the door leaf 22 guided in the slotted guide 10, for example via a driving spindle of a linear drive for the sliding movement. Of course, however, both door leaves 21, 22 could also be guided in a slotted guide 10.

Figure 2:
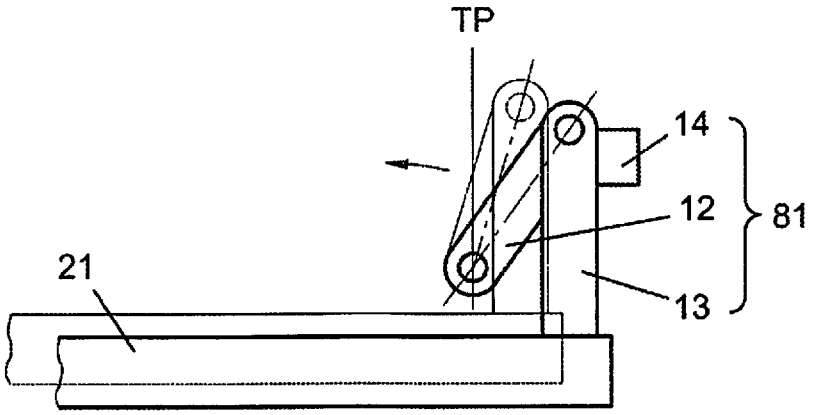
FIG. 2 shows a detailed view of an over-center locking.

FIG. 2 shows by way of example the second over-center locking 81 which, in this example, comprises the deployment lever 12, the connecting lever 13 and the stop 14. In the position illustrated, the door leaf 21 is in the closed position. Pulling on same is pointless since the two levers 12 and 13 are in contact with the stop 14 and therefore the door leaf 21 cannot be moved further outward. If the door leaf 21 is pushed inward, the deployment lever 12 and the connecting lever 13 move to the left (see the intermediate position illustrated by thin lines), but only as far as the dead center TP. Furthermore, the door leaf 21 cannot be pushed inward either. For the (intentional) movement of the door leaf 21, the deployment lever 12 is set into rotation.

In the example illustrated in FIG. 1, the over-center lockings 41, 42 and 82 are constructed similarly to the over-center locking 81, wherein the first over-center lockings 41, 42 primarily fix the support 3 and therefore act only indirectly on the door leaves 21, 22. For the deployment movement of the support 3, the corresponding deployment lever of the first over-center lockings 41, 42 is set into rotation. Of course, the use of an over-center locking is not restricted to the specifically illustrated variant, but rather modifications of the functional principle are, of course, also conceivable.

In general, it should be noted that, because of the kinematic relationships, the first over-center lockings 41, 42 and the second over-center lockings 81, 82 may be constructed differently in particular in respect of the lever length thereof and/or the rotational angles of same. In addition, the rack drive 51, 52 and 61, 62 can be configured according to a required transmission ratio.

Figure 3:
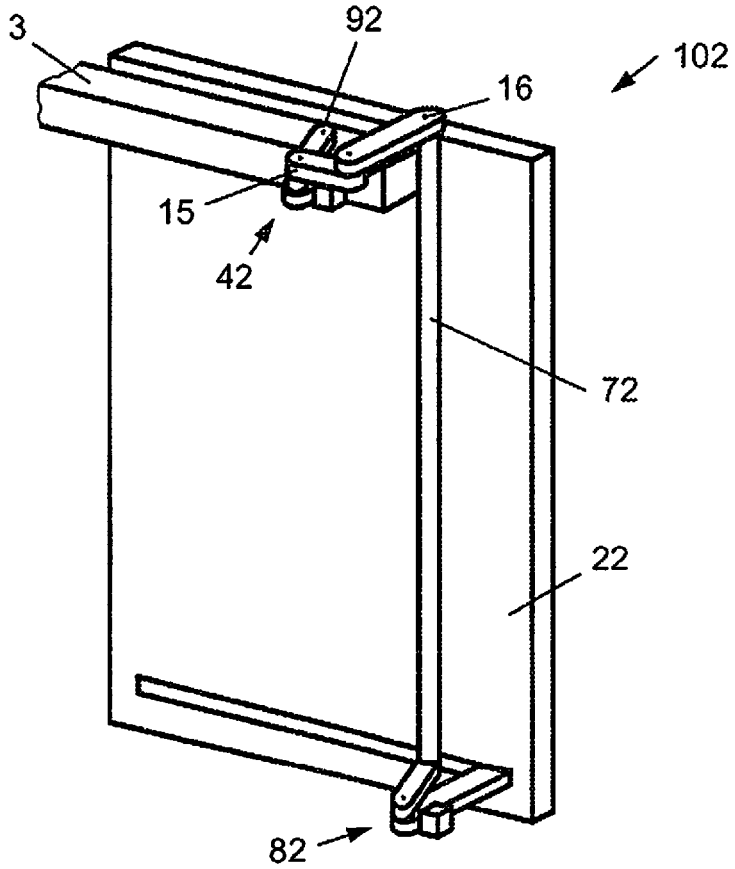
FIG. 3 shows a second schematically illustrated example of a swinging-sliding door module, in which a laterally deployable support is coupled to the rotary pillar via a lever system.

FIG. 3 shows a further possibility for coupling the support 3 to the rotary pillar 72. Specifically, FIG. 3 shows a swinging-sliding door module 102 in which the coupling mentioned is not carried out with the aid of a rack drive, but rather a movement of the upper over-center locking 42 is transmitted with the transmission lever 15 and the rotary lever 16 to the rotary pillar 72. If the upper over-center locking 42 is released, the transmission lever 15 is pulled to the left, as the result of which the rotary lever 16 and the rotary pillar 72 begin to rotate in the clockwise direction and, consequently, also release the lower over-center locking 82. It would also be conceivable for the rotary lever 16 to alternatively be connected to the support 3 via a further lever, or to be guided via a slotted guide arranged fixedly in the rail vehicle, and therefore the linear movement of the support 3 is converted into a rotational movement of the rotary pillars 71, 72.

Figure 4:
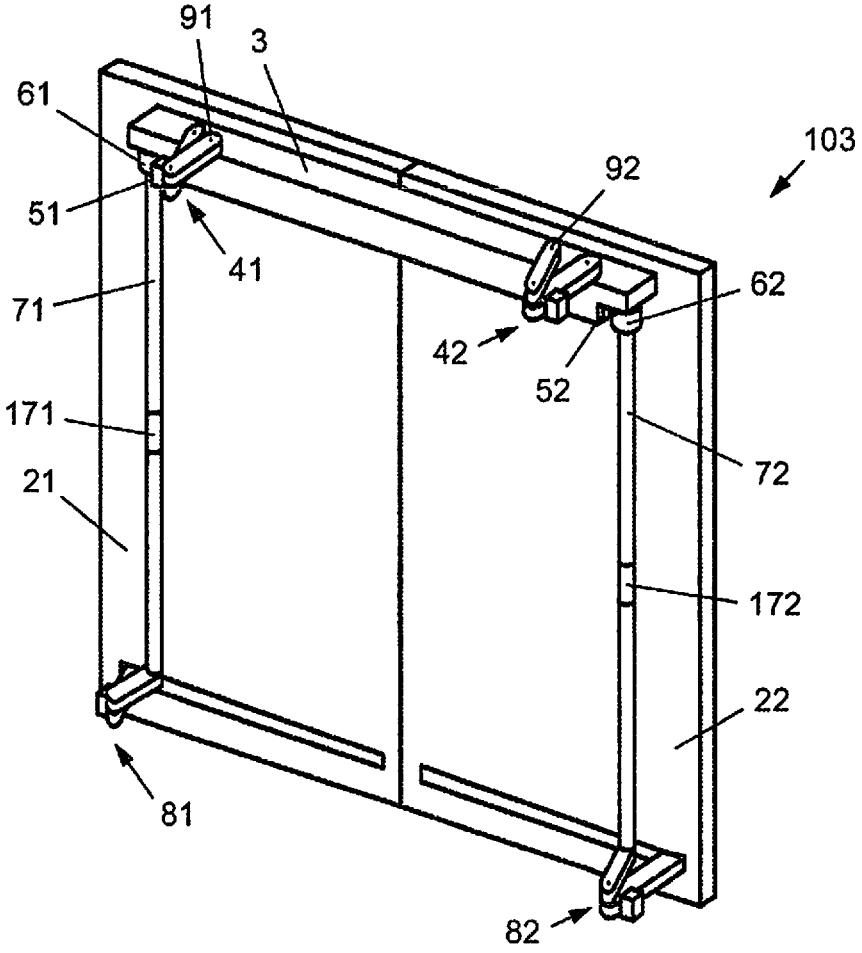
FIG. 4 is as per FIG. 1, only with a torsion damper in the rotary pillar.

FIG. 4 shows a further example of a swinging-sliding door module 103 which is very similar to the swinging-sliding door module 101 illustrated in FIG. 1. In contrast thereto, torsion dampers 171, 172, which can be composed, for example, of an elastomer, are integrated in the rotary pillars 71, 72. With the aid of the torsion dampers 171, 172, the first (upper) over-center lockings 41, 42 can be decoupled in respect of the dynamic behavior thereof, in particular in respect of the vibration behavior thereof, from the second (lower) over-center lockings 81, 82.

Dynamic influences occurring at a rail vehicle, in particular vibrations, may lead to an over-center locking overcoming the dead center and to a door suddenly springing open. However, the effect which can now be achieved by the torsion dampers 171, 172 mentioned is that not all of the over-center lockings 41, 42, 81, 82 are excited in the same manner and therefore also do not all jump open at the same time. Owing to the fact that one of the over-center lockings 41, 42, 81, 82 always remains locked, even if individual over-center lockings of the over-center lockings 41, 42, 81, 82 jump open because of dynamic phenomena, the door always remains closed. Though possible, that is to say different, vibration behavior of the first and second over-center locking 41, 42, 81, 82 is in any case already produced by the use of the torsion dampers 171, 172, this can, however, be further improved and also influenced in a targeted manner, by the asymmetric distribution of mass between support 3 and rotary pillar 71, 72. In addition to classical calculation, computer simulations and tests for coordinating the system can also be used.

It would also be conceivable for the rotary pillars 71 and 72 to be completely manufactured from a plastic which has the corresponding spring and damping properties. In this manner, the upper over-center lockings 41 and 42 can also be "out of tune" in relation to the lower over-center lockings 81 and 82. Separate torsion dampers 171, 172 can then be omitted.

Optionally, additional weights can also be attached to the swinging-sliding door module 103, or parts of same can be innately of correspondingly heavy design to obtain the desired dynamic behavior. The use of different materials would in turn be conceivable in this connection. For example, the first over-center lockings 41 and 42 could be manufactured from steel, whereas the second over-center lockings 81 and 82 could be manufactured from a lighter plastic, and therefore the individual lockings 41, 42, 81, 82 have a different vibration behavior with an otherwise identical shaping. Particularly high security against the unintentional jumping open of a sliding door can thereby be ensured.

It would also be conceivable in general not only to change the overall mass of a component, but rather the distribution of mass in the event of an overall mass which is identical per se. For example, the distribution of mass of the door leaf 21, 22 could be influenced in a targeted manner such that, in the event of excitation, a different vibration forms in the lower region than in the upper region. As a result, it can likewise be prevented that the first over-center lockings 41, 42 and the second over-center lockings 81, 82 jump open at the same time.

Figure 5:
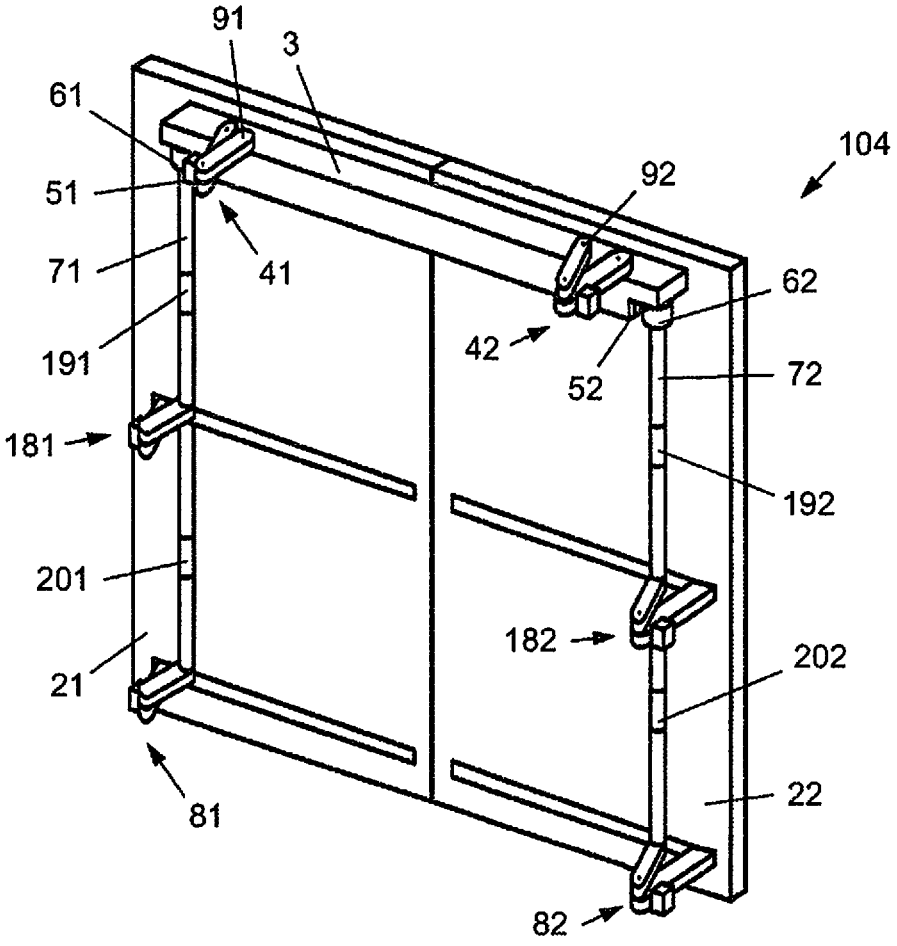
FIG. 5 is as per FIG. 4, only with a further second over-center locking and further torsion dampers in the rotary pillars.

FIG. 5 now shows a further embodiment of a swinging-sliding door module 104 which is very similar to the swinging-sliding door module 103 shown in FIG. 4. However, in contrast thereto, further second over-center lockings 181, 182 are arranged in the region of the center of the door leaf 21, 22. In addition four torsion dampers 191, 192, 201, 202 are provided. In this manner, the security can be increased once again. The door leaves 21, 22 are, on the one hand, held even better by the over-center lockings 181, 182, which are additionally provided in the central region; on the other hand, the over-center lockings 81, 82 can be dynamically decoupled from the over-center lockings 181, 182 with the aid of the torsion dampers 201, 202. Overall, the over-center lockings 41, 42, the over-center lockings 81, 82 and the over-center lockings 181, 182 possibly (in pairs) have a different vibration behavior. Of course, separate torsion dampers 191, 192, 201, 202 can also be omitted, in particular if the rotary pillars 71, 72 or the portions thereof are entirely manufactured from a damping material.

Of course, the cited teaching for configuring the vibration behavior of a swinging-sliding door module 103, 104 is not tied to the coupling of the support 3 to the rotary pillars 71, 72 via a rack drive 51, 52, 61, 62, but is equally applicable to the swinging-sliding door module 102 illustrated in FIG. 3. Additional influencing possibilities are provided here by the transmission lever 15 and the rotary lever 16 which can be appropriately designed, for example, in respect of the weight thereof, the distribution of mass thereof, the elasticity thereof and/or in respect of the damping thereof.

It is noted at this juncture that only half of a swinging-sliding door module 102 is illustrated in FIG. 3. In general, the embodiments illustrated are, of course, suitable both for single-leaf and also for multi-leaf swinging-sliding door modules 101 . . . 104.

Figure 6:
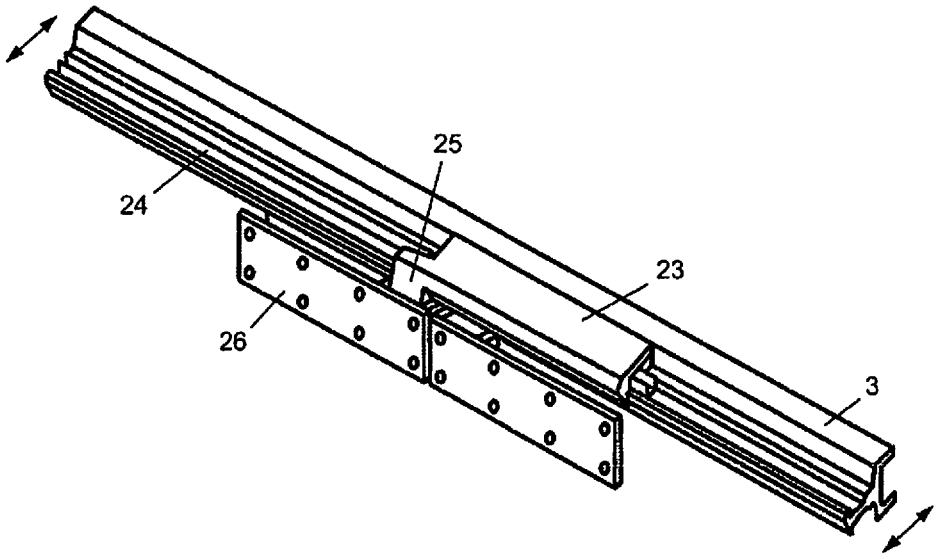
FIG. 6 shows an example of a linear guide system for the door leaves.

FIG. 6 now shows in somewhat more detail how the door leaves 21, 22 can be mounted displaceably on the support 3. Specifically, a guide carriage 23 is mounted displaceably on a profile rail 24. A mounting plate 26 is connected to the guide carriage 23 via a bracket 25. In particular, the mounting plate 26, to which the door leaf 22 is fastened, can also be mounted rotatably in the bracket 25. An analogously constructed guide system for the right door leaf 21 is located on the lower side of the support 3. In general, use can be made of both linear rolling guides and linear sliding guides.

For the drive of the door leaves 21, 22, it is possible, for example, for an endless cable to be placed in the longitudinal direction around the support 3 and to be connected to the guide carriages 23. If the cable is moved, the door leaves 21, 22 also move in opposite directions in synchronism. The use of a rack drive or spindle drive, for example, would also be conceivable.

Figure 7:
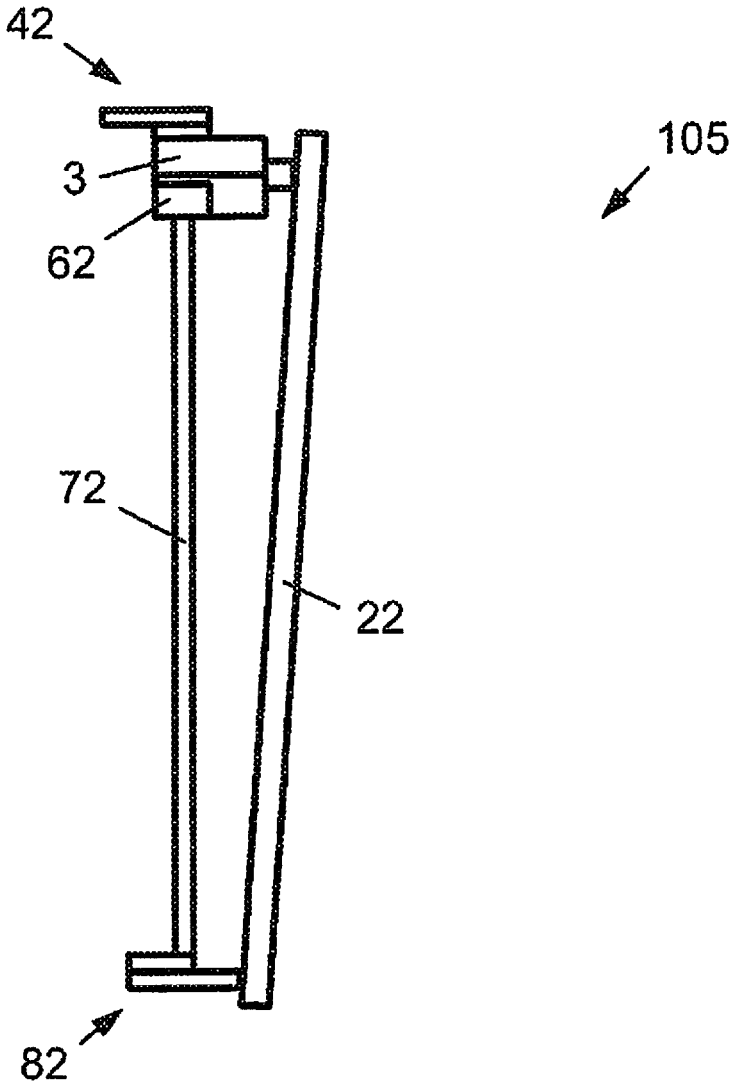
FIG. 7 shows a schematically illustrated example in which the door leaf tilts outwards at the top during the deployment movement.

FIG. 7 finally shows a side view of a swinging-sliding door module 105 similar to the swinging-sliding door module 101 illustrated in FIG. 1. In this example, a movement coupling between the first over-center lockings 42 and the second over-center lockings 82 is designed in such a manner that the deployment movement of the first over-center lockings 42 takes place at a different speed than the deployment movement of the second over-center lockings 82, and/or the deployment movements mentioned begin or end in a staggered manner. Specifically, in this example, the door leaf 22 is rotated about a horizontal axis, which runs in the plane of the door leaf 22, during the deployment movement. The mentioned rotational movement is realized here in such a manner that the door leaf 22 tilts outward at the top. To this end, the door leaf 22 is shown slightly deployed in FIG. 7.

By way of the rotational movement, a type of shearing movement takes place between door leaf 22 and door seal, and therefore door leaf 22 and seal are in contact only in a small region and only comparatively frictional forces occur. In particular in the event of icing in the sealing region, the driving forces for opening the door, upon which the ice is jettisoned, can thus be kept small. The rotational movement mentioned can be realized by the fact that the door leaf 22 is moved at the top at a different speed than at the bottom, and/or the movement is initiated in a staggered manner at the top and bottom.

Alternatively to the movement illustrated, the door leaf 22 can also tilt inward at the top. Alternatively or additionally to the vertical tilting, a horizontal tilting can also take place, i.e. the door leaf 22 can be first of all deployed on the left or right. If the horizontal tilting is combined with the vertical tilting, the advantages mentioned are particularly evident since the frictional forces between seal and door are particularly small because of the tilting "across the corner".

The exemplary embodiments show possible variant embodiments of a swinging-sliding door module 100 . . . 105 according to the disclosed embodiments, wherein it may be mentioned at this juncture that the disclosed embodiments is not restricted to the specifically illustrated variant embodiments thereof; rather, diverse combinations of the individual variant embodiments with one another are also possible, and this variation option, on account of the teaching relating to technical practice provided by the present disclosed embodiments, falls within the area of expertise of a person skilled in this technical field. The scope of protection therefore covers all conceivable variant embodiments which are made possible by combining individual details of the variant embodiment which is being illustrated and described.

In particular, it is emphasized that the devices illustrated may in reality also comprise more constituent parts than illustrated.

As a matter of form, it may be pointed out in conclusion that, to provide a better understanding of the construction of the swinging-sliding door module 100 . . . 105, the latter or the constituent parts thereof in some cases could not be illustrated to scale and/or have been illustrated on an enlarged and/or reduced scale.

The object on which the independent inventive solutions are based can be gathered from the description. Such an arrangement is basically known, for example, EP 1 314 626 B1, discloses in this regard a swinging-sliding door for vehicles with at least one door leaf which is displaceable in the longitudinal direction thereof, is suspended in a supporting guide and is guided displaceably. The supporting guide can be moved together with the door leaf from a closed position into a displacement position in which the door leaf is located on the outside in front of the vehicle wall. The arrangement here is such that the supporting guide passes in the closed position into a dead center position, and therefore the door can no longer be opened from the inside even by pushing. The door leaf is guided and supported in the region of the lower edge via roller guides which are each connected to a first pivot lever arranged on a rotary pillar, which is arranged vertically in the door frame. The upper end of the rotary pillar supports a second pivot lever which is connected to the supporting guide via a connecting rod, and therefore displacement of the supporting guide brings about a rotational movement of the rotary pillar.

LIST OF REFERENCE SIGNS

101 . . . 105 swinging-sliding door module
21, 22 door leaf
3 support
41, 42 first over-center locking
51, 52 rack
61, 62 gearwheel
71, 72 rotary pillar
81, 82 second over-center locking (at the bottom)
91, 92 bearing point
10 slotted mechanism
11 pin
12 deployment lever
13 connecting lever
14 stop
15 transmission lever
16 rotary lever
171, 172 torsion damper
181, 182 second over-center locking (center)
191, 192 torsion damper
201, 202 torsion damper
23 guide carriage
24 profile rail
25 bracket
26 mounting plate
TP dead center

The invention claimed is:

1. A swinging-sliding door module for a rail vehicle, the module comprising:

a door leaf;

a rotary pillar which is coupled to the door leaf and is mounted rotatably;

a support which is oriented longitudinally in a sliding direction of the door leaf, is mounted displaceably in a horizontal direction transversely with respect to a longitudinal extent thereof in relation to the rotary pillar and in which the door leaf is displaceably mounted;

a first over-center locking acting on the support in a deployment direction of the door leaf, wherein a coupling between the rotary pillar and the door leaf comprises a second over-center locking which acts in the deployment direction of the door leaf, and wherein the second over-center locking includes a deployment lever connected directly to a connecting lever at one end of the connecting lever, the deployment lever connected directly to the rotary pillar at an end of the deployment lever opposite the connection to the connecting lever, and a stop, wherein the connecting lever is coupled at an end opposite the connection to the deployment lever directly to the door leaf, and the rotary pillar is coupled at one end of the deployment lever.

2. The module of claim 1, further comprising a door drive system acting on the first over-center locking and, via the rotary pillar, on the second over-center locking.

3. The module of claim 1, wherein the door drive system comprises a linear drive which is coupled to the door leaf and acts in the sliding direction thereof.

4. The module of claim 2, wherein the door drive system has a single motor.

5. The module of claim 1, wherein the support is arranged in an upper region of the door leaf and the second over-center locking is arranged in a lower region of the door leaf.

6. The module of claim 5, further comprising a further second over-center locking arranged between the coupling of the rotary pillar to the support and the second over-center locking, in the central region of the door leaf.

7. The module of claim 1, wherein the rotary pillar is mechanically coupled to the support.

8. The module of claim 7, wherein the mechanical coupling between the rotary pillar and the support is formed by a gearwheel which is arranged on the rotary pillar and which is in engagement with a linear toothing arranged laterally on the support.

9. The module of claim 7, wherein the coupling between the rotary pillar and support comprises a rotary lever which is arranged on the rotary pillar and is guided in a slotted guide arranged on the support, or is connected via at least one further lever to the support, or is connected via at least one further lever to the first over-center locking.

10. The module of claim 1, wherein the rotary pillar has a torsion damper between the coupling of the rotary pillar to the support and the second over-center locking.

11. The module of claim 1, wherein the rotary pillar has a torsion damper between with the second over-center locking and a third over-center locking.

12. The module of claim 1, wherein a movement coupling between the first over-center lockings and the second over-center lockings is designed in such a manner that the deployment movement of the first over-center lockings takes place at a different speed than the deployment movement of the second over-center lockings and/or the deployment movements mentioned begin or end in a staggered manner.

13. The module of claim 1, wherein the first over-center locking comprises a deployment lever connected directly to a connecting lever at one end of the connecting lever, the connecting lever connected directly at an opposite end to bearing points anchored fixedly to the rail vehicle, and a stop.

14. The module of claim 13, wherein a coupling between the rotary pillar and the support comprises a gearwheel on the rotary pillar coupled with a linear toothing on the support.

15. The module of claim 13, wherein the support further comprises a profile rail, and a guide carriage mounted displaceably on the profile rail, wherein a mounting plate is connected of the guide carriage via a bracket and the door leaf is coupled to the mounting plate.

16. The module of claim 15, further comprising a motor connected to a gearing configured to drive a sliding and a deployment movement of the door leaf.

* * * * *